US006040551A

United States Patent [19]

Manz et al.

[11] Patent Number: 6,040,551

[45] Date of Patent: Mar. 21, 2000

[54] APPARATUS FOR HARDENING THE INSIDE CONTOUR OF A GUN BARREL WITH LASER RADIATION

[75] Inventors: Herbert Manz, Leverkusen; Haluk Tuncer, Düsseldorf; Manfred Zaeper, Unterüss, all of Germany

[73] Assignee: Rheinmetall W & M GmbH, Unterluss, Germany

[21] Appl. No.: 09/156,501

[22] Filed: Sep. 18, 1998

[30] Foreign Application Priority Data

Sep. 18, 1997 [DE] Germany ..... 197 41 028

[51] Int. Cl.[7] ..... B23K 26/00; B23K 26/14

[52] U.S. Cl. ..... 219/121.65

[58] Field of Search ..... 219/121.65, 121.66, 219/121.63, 121.64, 121.68, 121.69, 121.84

[56] References Cited

U.S. PATENT DOCUMENTS

| | | | |
|---|---|---|---|
| 3,772,496 | 11/1973 | Harendza-Harinxma | 219/121.69 |
| 4,978,834 | 12/1990 | Griffaton | 219/121.63 |
| 5,160,556 | 11/1992 | Hyde et al. | 219/121.85 |
| 5,262,613 | 11/1993 | Norris et al. | 219/121.68 |
| 5,426,278 | 6/1995 | Hirano et al. | 219/121.63 |
| 5,719,373 | 2/1998 | Snyder et al. | 219/121.65 |

FOREIGN PATENT DOCUMENTS

| | | |
|---|---|---|
| 0 364 366 | 4/1990 | Germany . |
| 0 406 043 | 1/1991 | Germany . |
| 0 408 405 A1 | 1/1991 | Germany . |
| 195 44 824 A1 | 11/1993 | Germany . |
| 42 41 592 C1 | 2/1997 | Germany . |

*Primary Examiner*—Geoffrey S. Evans
*Attorney, Agent, or Firm*—Venable; George Spencer; Norman N. Kunitz

[57] ABSTRACT

An apparatus for hardening the inside contour of a gun barrel (1) with laser radiation, which apparatus includes a laser, a laser head (10) that can be disposed to be displaced along the bore axis (4) of the gun barrel (1), and beam-deflecting optics (17) disposed in the laser head so that the laser radiation can be coupled into the muzzle of the gun barrel (1) and guided perpendicularly to the inside surface (5) of the gun barrel (1) by the beam-deflecting optics (17). To harden the gun barrel (1) with high precision and homogeneity, and make available a processing space that is relatively large in comparison to known apparatuses, an ND:YAG laser is used as the laser, and, due to the shorter wavelength in comparison to $CO_2$ lasers, a glass or optical fiber (11) is used for transmitting the laser beam to the laser head. Moreover, the laser head (10) is secured to a drawing rod (3) that can be centered within the gun barrel (1) and displaced in the direction of the bore axis (4) of the gun barrel (1).

6 Claims, 2 Drawing Sheets

APPARATUS FOR HARDENING THE INSIDE CONTOUR OF A GUN BARREL WITH LASER RADIATION

REFERENCE TO RELATED APPLICATIONS

This application claims the priority of German Application Serial No. DE 197 41 028.6, filed Sep. 18, 1997, which is incorporated herein by reference.

BACKGROUND OF THE INVENTION

The invention relates to an apparatus for hardening the inside contour of a gun barrel with laser radiation. More particularly, the present invention relates to an apparatus for hardening the inside contour of a gun barrel with laser radiation, which apparatus is of the type including a laser, and a laser head, which can be disposed to be displaced along the bore axis of the gun barrel and which has beam-deflecting optics, so that the laser radiation can be coupled into the muzzle of the gun barrel and guided perpendicularly to the inside surface of the gun barrel by means of the beam-deflecting optics.

To maintain a low level of erosion of the respective gun barrel due to the hot propellant gases, or a low level of abrasive wear caused by the friction between the projectile and the gun barrel, and thereby extend the service life of the weapon, it is known to provide the inside surface of the gun barrel, usually comprising steel, with a hard-metal layer, for example, a chromium layer or an alloy layer containing chromium (e.g. a cobalt-chromium-tungsten alloy).

A disadvantage of such gun barrels is that the application of the surface layer is a relatively complicated process, and the layer frequently chips off and washes out, which shortens the service life of the gun barrels.

It is further known, from German Published Patent Application No. DE 195 44 824 A1, to harden the inside surface of the respective gun barrel through a thermal surface treatment with laser beams (transformation hardening). In this process, the laser radiation of a $CO_2$ laser is coupled axially into the muzzle of the gun barrel, and is conducted, with the aid of a laser head disposed to be displaced in the gun barrel and including beam-deflecting optics, perpendicularly to the inside surface of the gun barrel to be hardened.

A drawback of this known laser arrangement is that the use of the $CO_2$ laser necessitates a relatively rigid beam-guidance system, so the processing space is limited. In addition, it cannot be determined from this publication how the relative motion necessary between the gun barrel and the laser head could be realized.

It therefore is the object of the present invention to provide an apparatus for transformation hardening of the inside contour of a gun barrel, with which the gun barrel can be hardened very precisely and homogeneously; in addition, the processing space can be increased with the intended use of the apparatus.

SUMMARY OF THE INVENTION

The above object generally is achieved according to the present invention by an apparatus for hardening the inside contour of a gun barrel with laser radiation, which apparatus comprises: an ND:YAG laser; a drawing rod having means for centering the rod in a gun barrel and being mounted for displacement in the direction of a bore axis of the gun barrel; a laser head secured to the muzzle facing end of the rod for displacement along the bore axis of the gun barrel; an optical fiber conducting the output radiation beam of the laser to said laser head; and beam-deflecting optics dispose in said laser head for guiding the laser radiation exiting said optical fiber out of the laser head via a beam exit opening and onto the inside surface of the gun barrel in a direction perpendicular to the inside surface of the gun barrel. Further advantageous embodiments and modification of the invention are disclosed.

The essential concept underlying the invention is, on the one hand, using an ND:YAG laser as the laser because, due to the wavelength of 1.06 $\mu$m, which is shorter than in $CO_2$ lasers, glass fibers can be used for transmitting the laser beam. On the other hand, securing the laser head to a drawing rod that can be centered in the gun barrel (and thus supported at the barrel walls) and can be displaced in the direction of the bore axis of the gun barrel helps to maintain a very precise focus position of the laser beam during the hardening process.

It has proven particularly advantageous to use the drawing rod of a known program-controlled, pull-type groove cutting or keyway making machine, in which the drawing rod can be drawn through the gun barrel very precisely along a defined path via a machine sled. The relative focus position of the laser beam always remains constant because of the bushings guided along with the rod in the barrel.

Because the absorption rate of the laser beams of an ND:YAG laser is about 30–50% higher than that of a $CO_2$ laser, no absorption-increasing coating means are necessary in the use of an ND:YAG laser, so more homogeneous layers are formed than with a $CO_2$ laser.

Further details and advantages of the invention ensue from the embodiment explained in conjunction with the drawing figures.

DETAILED DESCRIPTION OF THE PREFERRED EMBODIMENT

Figure 1:
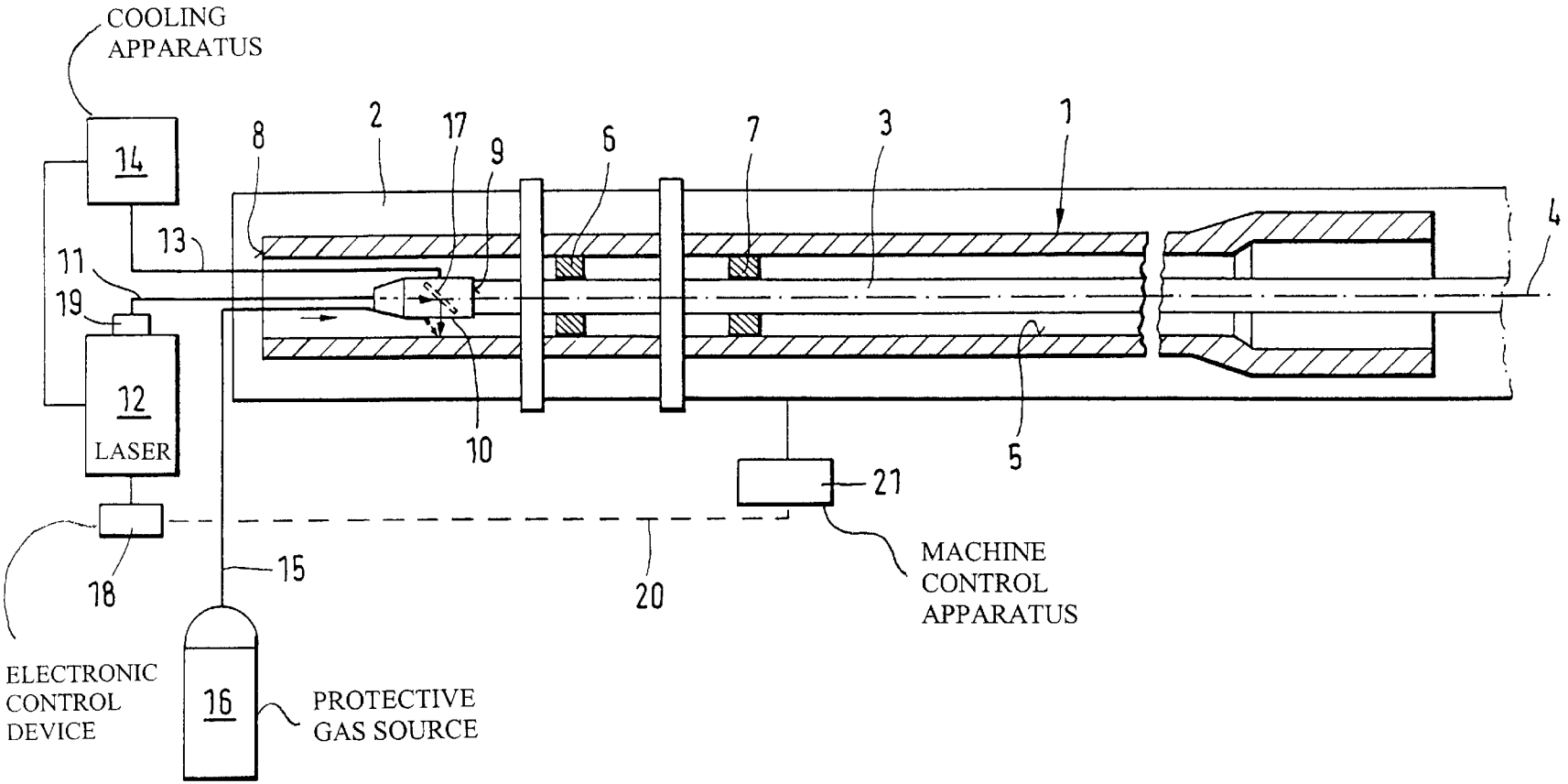
FIG. 1 schematically shows a longitudinal sectional view of a gun barrel to be hardened together with a laser system and a program-controlled, pull-type groove-cutting or keyway making machine according to the invention.

FIG. 1 shows a gun barrel 1, which is oriented or aligned and fixed or secured on a pull-type groove cutting machine 2 of known design. The drawing rod 3 of the groove cutting machine extends inside gun barrel 1 along its bore axis 4, and is supported against the inside surface 5 of gun barrel 1 by two guide bushings 6 and 7 carried by the rod 3.

Mounted on the end 9 of the drawing rod 3 facing the muzzle end 8 of gun barrel 1 is a laser head 10, which is connected via an optical fiber 11, which extends out of the muzzle 8 of gun barrel 1, to an ND:YAG laser 12 (e.g. with a 2 kW output power), which is disposed outside of the gun barrel 1. Furthermore, laser head 10 is connected via a first hose line 13 to a cooling apparatus 14 for supplying cooling medium, e.g., water, to the laser head 10, and via a second hose line 15 to a protective-gas source 16, e.g., a gas tank filled with argon. The outlet end of hose line 15 opens in a direction toward the surface of the gun barrel 1 as can be seen in FIG. 1.

Laser head 10 essentially encompasses a faceted mirror 17, which focuses the laser beam exiting the end of optical fiber 11 onto the inside surface 5 of the gun barrel 1 to be hardened in a direction perpendicular to the bore axis 4. Due to the significant development of heat during operation, the mirror 17 is cooled by the cooling medium supplied via hose line 13 and directional toward the mirror 17. Laser head 10 is further connected to a second pipeline or hose line 15, by way of which a protective gas flows to the heated surface of the gun barrel 1 during transformation hardening and prevents the formation of an oxide layer, which reduces the surface quality. It is noted that the hose line 15 need not extend into the interior of the laser head 10 but may merely be attached or fastened to the exterior surface of head 10.

The apparatus of the invention can be used in transformation hardening of both rifled gun barrels and barrels having a smooth barrel profile. Tests have revealed that steel barrels can be transformation-hardened to a depth of 0.4 to 0.8 mm, with the hardened surface regions having between 600 and 750 HV.

As can be seen from FIG. 1, the apparatus of the invention includes an electronic control apparatus 18, which regulates the laser output and acts on a closing or shutter unit 19 disposed downstream of the output side of laser 12, and which continuously monitors the proper operation of the laser system such that, in the event of a detected defect, e.g., a break in the optical fiber 11 or an interrupted or insufficient cooling of the faceted mirror, etc., the control apparatus halts the hardening process of the gun barrel.

As indicated by the dashed line 20 in FIG. 1, the electronic control apparatus 18 is preferably connected to the control apparatus 21 for the groove cutting machine. This assures, on the one hand, the flexible embodiment of processing cycles and, on the other hand, the monitoring of safety-related locking mechanisms.

Figure 2:
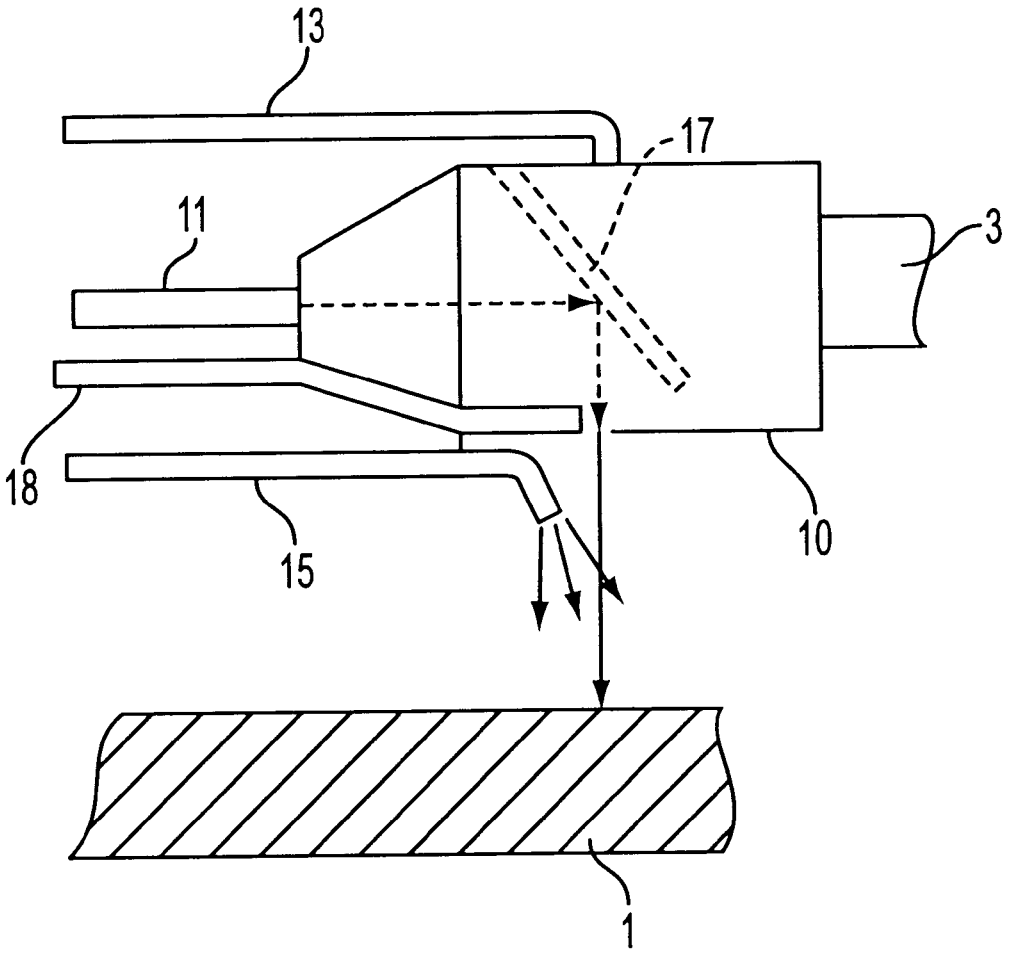
FIG. 2 is an enlarged schematic illustration of the laser head of FIG. 1 with an additional feature of a compressed air line.

The invention is, of course, not limited to the above-described embodiment. For example, as shown in FIG. 2, in addition to the pipelines or hose lines 13 and 15, a third pipeline or hose line 18 can be provided and attached to the laser head 10 to provide a stream of compressed air or nitrogen. The outlet of the additional hose line 18 is positioned to provide a layer of air in a direction transverse to and over the beam-exit opening of the laser head 10. This directed gas current across the laser beam exit opening protects the mirror optics 17 and the interior of the laser head 10 against contamination.

The invention now being fully described, it will be apparent to one of ordinary skill in the art that many changes and modifications can be made thereto without departing from the spirit or scope of the invention as set forth herein.

What is claimed:

1. An apparatus for hardening the inside contour of a gun barrel with laser radiation, said apparatus comprising:

a ND:YAG laser; a program controlled groove cutting machine having a drawing rod which is pulled during linear displacement, and means for centering the rod in a gun barrel for displacement in the direction of a bore axis of the gun barrel; a laser head secured to the muzzle end of the rod for displacement along the boare axis of the gun barrel; an optical fiber connecting the output radiation of the laser to said laser head; and, beam-deflecting optics disposed in said laser head for guiding laser radiation exiting said optical fiber out of the laser head via a beam exit opening in a direction onto the inside surface of the gun barrel in a direction perpendicular to the inside surface of the gun barrel.

2. The apparatus according to claim 1, wherein the beam-deflecting optics of the laser head is a faceted mirror that focuses the laser radiation onto the inside surface of the gun barrel.

3. The apparatus according to claim 1, wherein the laser head is connected, via a pipeline or hose line that can be guided out of the muzzle of the gun barrel, to a cooling apparatus supplying a cooling medium for cooling the beam-deflecting optics.

4. The apparatus according to claim 3, wherein a further pipeline or hose line has one end connected to a protective-gas source and its other end extending through the muzzle of the gun barrel to the laser head and fastened to the laser head such that the protective gas flows in a direction toward the inside surface of the gun barrel when the surface is irradiated by the laser radiation.

5. The apparatus according to claim 4, wherein: a third pipeline or hose line is connected between the laser head and a compressed air or nitrogen source for supplying compressed air or nitrogen to the laser head; and the exit opening of the third pipeline or hose line is oriented such that the gas exits the third pipeline transversely to and across the beam-exit opening of the laser head to protect the beam-deflecting optics and the interior of the laser head from contamination.

6. The apparatus according to claim 1, further comprising: a shutter unit disposed downstream of the laser output between the laser output and the optical fiber; and an electronic control apparatus, which regulates the laser output and acts on the shutter unit to halt the hardening process in the event of a detected fault in the apparatus.

* * * * *

UNITED STATES PATENT AND TRADEMARK OFFICE
CERTIFICATE OF CORRECTION

PATENT NO : 6,040,551
DATED : March 21, 2000
INVENTOR(S) : Herbert Manz et al.

It is certified that error appears in the above-identified patent and that said Letters Patent are hereby corrected as shown below:

On the title page, change line [75] to read --Herbert Manz, Leverkusen; Haluk Tuncer, Düsseldorf; Manfred Zaeper, Unterlüß; Harald Weismüller, Hermannsburg, all of Germany--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*